US005954949A

United States Patent [19]

Ohsol et al.

[11] Patent Number: 5,954,949

[45] Date of Patent: Sep. 21, 1999

[54] CONVERSION OF HEAVY PETROLEUM OILS TO COKE WITH A MOLTEN ALKALI METAL HYDROXIDE

[75] Inventors: Ernest O. Ohsol, Crosby; Thomas E. Gillespie; John W. Pinkerton, both of Houston; Thomas H. Laity, Nassau Bay, all of Tex.

[73] Assignee: UniPure Corporation, Houston, Tex.

[21] Appl. No.: 09/048,194

[22] Filed: Mar. 25, 1998

[51] Int. Cl.[6] ..... C10G 9/14

[52] U.S. Cl. ..... 208/131; 208/132; 208/226; 208/230

[58] Field of Search ..... 208/131, 132, 208/226, 230

[56] References Cited

U.S. PATENT DOCUMENTS

| | | | |
|---|---|---|---|
| 3,164,545 | 1/1965 | Mattox | 208/230 |
| 3,179,584 | 4/1965 | Hamner et al. | 208/106 |
| 3,553,279 | 1/1971 | Bawa | 585/635 |
| 3,723,291 | 3/1973 | Thakker | 208/131 |
| 3,803,023 | 4/1974 | Hamner | 208/127 |
| 3,835,033 | 9/1974 | Dugan et al. | 208/226 |
| 3,936,358 | 2/1976 | Little | 208/131 |
| 3,948,759 | 4/1976 | King et al. | 208/106 |
| 4,092,236 | 5/1978 | Heredy | 208/404 |
| 4,148,692 | 4/1979 | Chu et al. | 201/36 |
| 4,178,229 | 12/1979 | McConaghy et al. | 208/50 |
| 4,529,501 | 7/1985 | George | 208/127 |
| 4,849,025 | 7/1989 | Bain et al. | 134/22 |
| 5,258,115 | 11/1993 | Heck et al. | 208/131 |
| 5,466,361 | 11/1995 | Heck et al. | 208/131 |
| 5,695,631 | 12/1997 | Eguchi et al. | 208/50 |

FOREIGN PATENT DOCUMENTS 929689 5/1982 U.S.S.R. .

*Primary Examiner*—Walter D. Griffin
*Attorney, Agent, or Firm*—Jenkens & Gilchrist, P.C.

[57] ABSTRACT

A method is described for making a high purity coke fuel or anode grade coke from a heavy petroleum residuum by contacting a molten anhydrous alkali metal hydroxide with the heavy petroleum residuum at a temperature and for a time sufficient to extract substantially all sulfur and heavy metals contained in the petroleum residuum to the alkali metal hydroxide and recovering the coke product.

26 Claims, 2 Drawing Sheets

CONVERSION OF HEAVY PETROLEUM OILS TO COKE WITH A MOLTEN ALKALI METAL HYDROXIDE

FIELD OF THE INVENTION

The present invention relates to a process for making a high purity coke fuel or anode grade coke from a low value, heavy petroleum residuum having a high content of sulfur and heavy metals. More particularly, the present invention relates to coking the heavy petroleum residuum in the presence of a molten anhydrous alkali metal hydroxide.

BACKGROUND OF THE INVENTION

In the petroleum refining art for upgrading of heavy petroleum fractions, it is frequently the practice to direct such fractions to a delayed coking unit to produce coke and lighter hydrocarbon products. Typical of such heavy petroleum fractions, also referred to as heavy petroleum residua, is the bottoms fraction from a vacuum distillation tower. Vacuum distillation towers generally are used to further fractionate the bottoms fraction from a crude oil atmospheric tower. Other fractions which can be furthered processed in a delayed coker unit include the bottoms residuum from the main fractionation of a catalytic cracker, and other residua having an initial boiling temperature of about 430° C. or higher. These heavy petroleum residua have generally a high content of sulfur and heavy metals, which render them unsuitable for fluid catalytic cracking because of their tendency to foul and deactivate the catalysts. The coke made from these heavy petroleum residua using a conventional delayed coking unit has a high content of sulfur, heavy metals and in the instance when the bottoms from a catalytic cracker is used the coke may also contain catalyst leftover material such as silica and alumina.

The delayed coking process is a well known refinery process. In a typical delayed coking process, a high boiling residuum is heated to very high temperatures to extract the last usable hydrocarbons in an acceptable boiling range such as light naphtha, diesel or light fuel oil, leaving as a final residue, a solid coke containing from about 85% to about 96% carbon.

More specifically, in a delayed coking process, which is essentially a high severity thermal cracking, the heavy oil feedstock is heated rapidly in a fired heater or tubular furnace from which it flows directly to a large coking drum which is maintained under conditions at which coking occurs, generally with temperatures above about 450° C. under a slight superatmospheric pressure. In the drum, the heated feed decomposes to form coke and volatile components which are removed from the top of the drum and passed to a fractionator. When the coke drum is full of solid coke, the feed is switched to another drum and the full drum is cooled and emptied of the coke product. Generally, at least two coking drums are used so that one drum is being charged while coke is being removed from the other.

When the coking drum is full of solid coke, the hydrocarbon vapors are purged from the drum with steam. The drum is then quenched with water to lower the temperature to about 93° C. after which the water is drained. When the cooling step is complete, the drum is opened and the coke is removed by hydraulic mining or cutting with high velocity water jets. A high speed, high impact water jet cuts the coke from the drum. A hole is bored in the coke from water jet nozzles located on a boring tool. Nozzles oriented horizontally on the head of a cutting tool cut the coke from the drum.

There are basically three different types of solid coke products which are different in value, appearance and properties. They are needle coke, sponge coke and shot coke. Needle coke, also known as anode grade or premium coke, is the highest quality of the three varieties. Needle coke, upon further treatment, has high conductivity and is used in electric arc steel production. It is low in sulfur and metals and is typically produced from some of the higher quality coker charge stocks which include more aromatic feedstocks such as slurry and decant oils from catalytic crackers and thermal cracking tars as opposed to the asphaltenes and resins.

Sponge coke, a lower quality coke, sometimes called "regular coke," is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can only be used as a cheap fuel. The name "sponge coke" comes from its porous, sponge-like appearance.

Shot coke is the lowest quality coke because it has the highest sulfur and metals content, the lowest electrical conductivity, and is the most difficult to grind. The name shot coke comes from the shape which is similar to that of B—B sized balls. The shot coke has a tendency to agglomerate into larger masses, sometimes as much as a foot in diameter, which can cause refinery equipment and processing problems. Shot coke is made from the lowest quality high resin-asphaltene feeds and makes a good high sulfur fuel source. It can also be used in cement kilns and steel manufacture.

While conventional delayed coking processes can convert a wide variety of petroleum residues, the product quality depends upon the type of feedstock used. Generally, low quality feeds produce low quality coke and liquid and gaseous products, having a high content of sulfur, heavy metals, and other inorganic contaminants. Existing processes for making high purity coke utilize higher quality feedstocks having low sulfur and heavy metals content or include treating the feedstock to remove these contaminants prior to the coking step.

For instance, U.S. Pat. No. 5,695,631, issued to Eguchi, et al., describes a process for making needle coke by reducing the ash content of a heavy oil residuum to less than 0.01 wt % and subsequently coking the thus treated heavy oil. U.S. Pat. No. 4,178,229, issued to McConaghy, et al., describes a process for making needle coke from a heavy hydrocarbon material such as vacuum residue, by subjecting it to a hydrogen donor diluent cracking operation ("HDDC"), fractionating the effluent from the HDDC process, and using the pitch from the fractionator as feedstock to a premium coker unit.

Also, the required equipment is generally expensive, since conventional coking processes involve handling solids and heat transfer at very high temperatures. Often, as described in detail above, the coke is formed in bulk and must be recovered by use of expensive hydraulic cutting equipment.

U.S. Pat. Nos. 3,179,584, 3,803,023, 5,258,115 and 5,466,361 describe coking processes involving the use of alkali metal compounds. However, none of these processes is suitable for making high purity, anode grade coke, which is the object of the present invention.

U.S. Pat. No. 3,179,584, issued to Hammer, describes a coking process utilizing alkali metal compounds in order to increase the hydrogen content of a coker's gaseous products. U.S. Pat. No. 3,803,023, issued to Hammer, describes a process using an alkali metal containing coke produced in a coking zone which is subsequently steam treated in a separate gasification zone to produce a hydrogen-containing gas and the remaining coke is recycled to the coking zone as seed coke.

U.S. Pat. No. 5,258,115, issued to Heck, et al., describes a process for recycling caustic waste which consists of introducing caustic waste (spent caustic) to a delayed coking unit during coking of a conventional coker feedstock. Finally, U.S. Pat. No. 5,466,361, issued to Heck, et al., describes a process for disposing caustic waste, which consists of co-injecting the caustic waste with a coker feedstock, and the subsequent gasification of the resulting coke product.

Therefore, the problem of producing high purity coke, substantially free from sulfur and heavy metals directly from a heavy petroleum residuum having a high content of sulfur and metals, remains unsolved.

SUMMARY OF THE INVENTION

The present invention overcomes the disadvantages associated with conventional coking processes. Moreover, it allows for the production of high purity coke from heavy hydrocarbon residua having a high content of contaminants such as sulfur and heavy metals. The coking process of the present invention has a lower investment cost than conventional coking processes, and simultaneously removes sulfur, heavy metals and inorganic solid contaminants to produce a high purity coke that is suitable for fuel or anode-grade coke applications. In addition, the invention process leaves no environmentally harmful by-products.

It is, therefore, an object of the present invention to provide a process for making a coke product that is substantially free of sulfur and heavy metals from low value, heavy petroleum residua. It is yet another object of the present invention to provide a continuous process in which a heavy oil residuum is injected into a molten bath of an anhydrous alkali metal hydroxide under coking conditions with continuous removal of low boiling products and well-devolatilized, high purity coke.

Accordingly, the present invention, in its broadest aspects, is directed to a method for making a coke product substantially free of sulfur and heavy metals from a heavy petroleum residuum having a high content of sulfur and heavy metal contaminants by contacting a molten anhydrous alkali metal hydroxide with the heavy petroleum residuum under coking conditions and for a time sufficient to extract substantially all sulfur and heavy metal compounds from the petroleum residuum in the alkali metal hydroxide. The extraction process is helped by reacting the sulfur and heavy metal compounds contained in the petroleum residuum with the alkali metal hydroxide to form compounds that are soluble in the alkali metal hydroxide. The petroleum residuum is converted to high purity coke and volatile compounds. The formed coke is of high purity and suitable in anode grade coke applications such as in electric arc steel production. The coke may also be used as a low sulfur fuel. Suitable coking conditions include heating the petroleum residuum under slight superatmospheric pressure or higher to a temperature of at least about 450° C., preferably of from about 480° C. to about 620° C. and most preferably of from about 500° C. to about 550° C., while in contact with the molten alkali metal hydroxide. The contacting step is preferably performed in a drum having a perforated plate securely positioned therein so as to feed the hydrocarbon residuum through the perforated plate for improved contact between the alkali metal hydroxide and the heavy petroleum residuum. The drum may be sized to allow from about 1 minute to 30 minutes, preferably from about 5 minutes to about 20 minutes and most preferably from about 8 minutes to about 12 minutes contacting time. Time will, at least in part, depend upon the hydrocarbon droplet size and temperature of the melt. The coke is recovered as a product from the molten mass and the contaminants are removed from the alkali metal hydroxide for disposal.

DETAILED DESCRIPTION OF THE INVENTION

Figure 1:
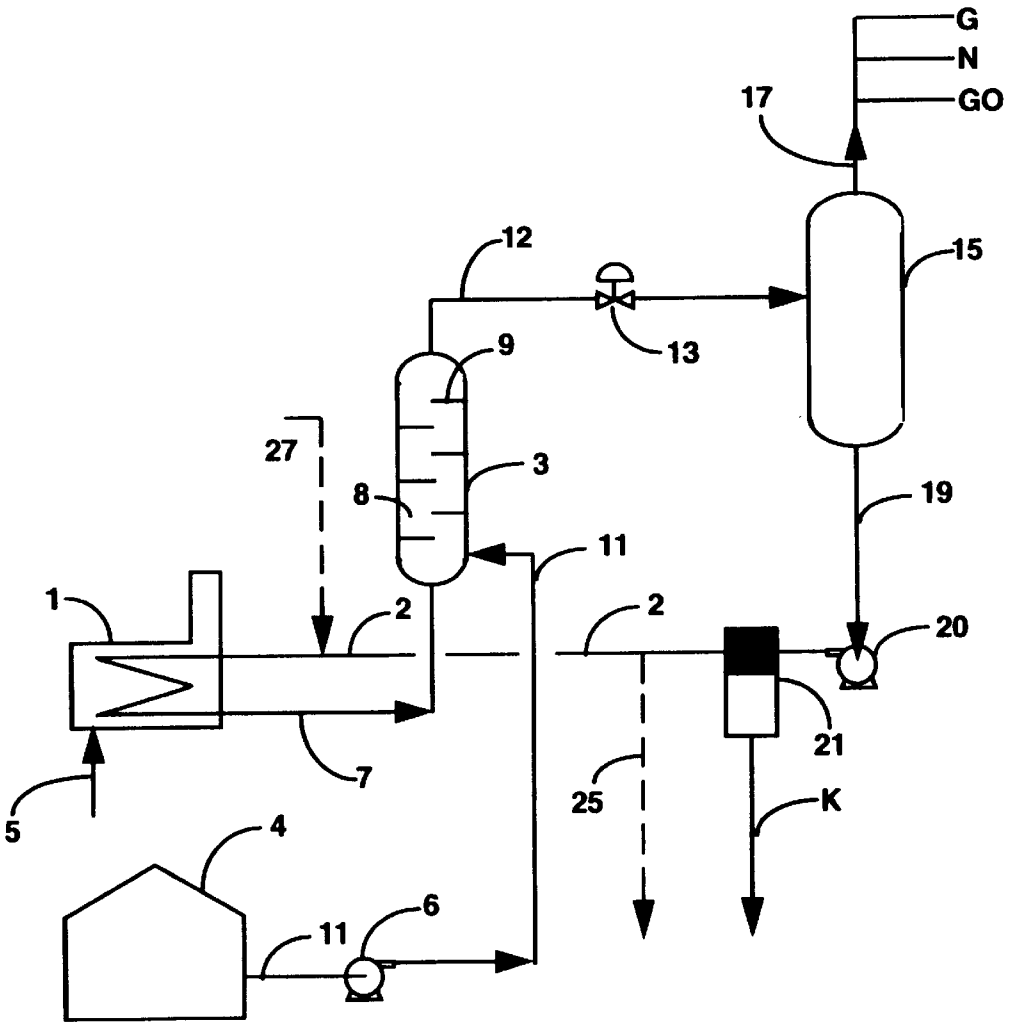
FIG. 1 shows, in schematic form, a basic embodiment of the process used in the practice of this invention.

Referring now to FIG. 1, a continuous process is shown in which a heavy hydrocarbon residuum stream 11 from storage tank 4 is continuously injected, using conventional pump 6, into a bath of a molten anhydrous alkali metal hydroxide 8 inside a contacting drum 3. As shown in FIG. 1, a circulating loop of a molten anhydrous alkali metal hydroxide is established, heat being steadily supplied by a furnace 1. The molten alkali metal hydroxide is kept under at least a slightly superatmospheric pressure, preferably from about 70 to about 120 psig. Molten alkali metal hydroxide coming out from furnace 1 is fed into the contacting drum 3 through line 7. Care should be taken to keep the temperature and flow rate of the incoming alkali metal hydroxide stream 7 sufficiently high in order to maintain the temperature within the contacting drum 3 above about 450° C., preferably of from about 480° C. to about 620° C. and most preferably of from about 500° C. to about 550° C., under at least a slight superatmospheric pressure. Under these conditions, the heated hydrocarbon feed 11 is decomposed to form high purity coke and volatile components, within the contacting drum 3.

Contacting drum 3 is sized to allow sufficient contact time between the hydrocarbon residuum and the molten alkali hydroxide to extract substantially all sulfur and heavy metal compounds from the hydrocarbon residuum in the molten alkali metal hydroxide phase. The extraction is helped by the reaction of sulfur and metal compounds with the alkali metal hydroxide to form reaction products which are soluble in the alkali metal hydroxide. For instance, the sulfur compounds form alkali metal sulfides such as sodium sulfide in the instance when sodium hydroxide is used. Also, heavy metals and their oxides form alkali metal-metal oxide compounds such as sodium ferrite, sodium nickelate and sodium vanadate. Water and hydrogen are released during these reactions. Contact time depends upon the droplet size of the petroleum residuum within the contacting drum 3, and the reaction temperature. The droplet size depends upon the mixing conditions within the contacting drum 3. Generally less contact time is required at higher mixing and reaction temperature conditions. Baffles 9 may be securely positioned within the contacting drum to facilitate mixing. Of course other methods and mixing devices may also be used in order to facilitate mixing within the contacting drum 3 such as installing a perforated plate at the petroleum inlet. Normally the contact time may range from about 1 minute to about 30 minutes, preferably from about 5 minutes to about 20 minutes and most preferably from about 8 minutes to about 12 minutes.

The alkali metal hydroxide feed to the contacting drum 3 is maintained at the desired temperature by passing it through furnace 1. The furnace 1 can be any of many well known furnaces in the art of heat transfer equipment for fused solids. The furnace fuel 5 may be natural gas, cheap fuel oil or some of the gas or liquid products made by this coking process. The coke produced by this process could also be used as a fuel for this furnace.

Effluent stream 12, leaving the contacting drum 3, is a slurry of coke particles suspended in the molten alkali metal hydroxide along with liquid cracking products and dissolved gas such as methane. Effluent stream 12 is released through a pressure control valve 13, into a flash drum 15 in which substantially all of the volatile compounds are separated from the liquid slurry. Flash drum 15 operates at a pressure ranging from about 30 to about 70 psig. The volatile compounds leaving the flash drum 15 through line 17 may be further processed to recover gas G, naphtha N, and gas oil GO fractions using well established fractionation techniques. The liquid slurry stream 19 coming out from the bottom of the flash drum 15 is moved by pump 20 into separation devices 21 to be separated into solid coke product of high purity K and a molten alkali metal hydroxide stream 2. Separation devices 21, may be one of many devices for separating solids from liquid slurries, which are well known to those skilled in the art such as hydrocyclones, high temperature centrifuges or filters.

The recovered alkali metal hydroxide is conducted through line 2, furnace 1 and line 7 into the contacting drum 3 to close the alkali metal hydroxide loop. A portion of the circulating alkali metal hydroxide is bled off through line 25 in order to keep the level of accumulating impurities, including sulfur and heavy metal by-products, in the molten alkali metal hydroxide below about 5 percent by weight. The portion removed is purified, and an adequate amount of fresh anhydrous alkaline metal hydroxide 27 in the form of flakes, powder, or granules is added to replace the amount removed. It is important, though not necessary, to the practice of this invention that at all times the purity of the molten alkali metal hydroxide that comes into contact with the heavy petroleum residuum is maintained above 95 percent by weight and preferably above 98 percent by weight. For best results, the purity of the molten alkali metal hydroxide should be maintained above 99 percent by weight.

Figure 2:
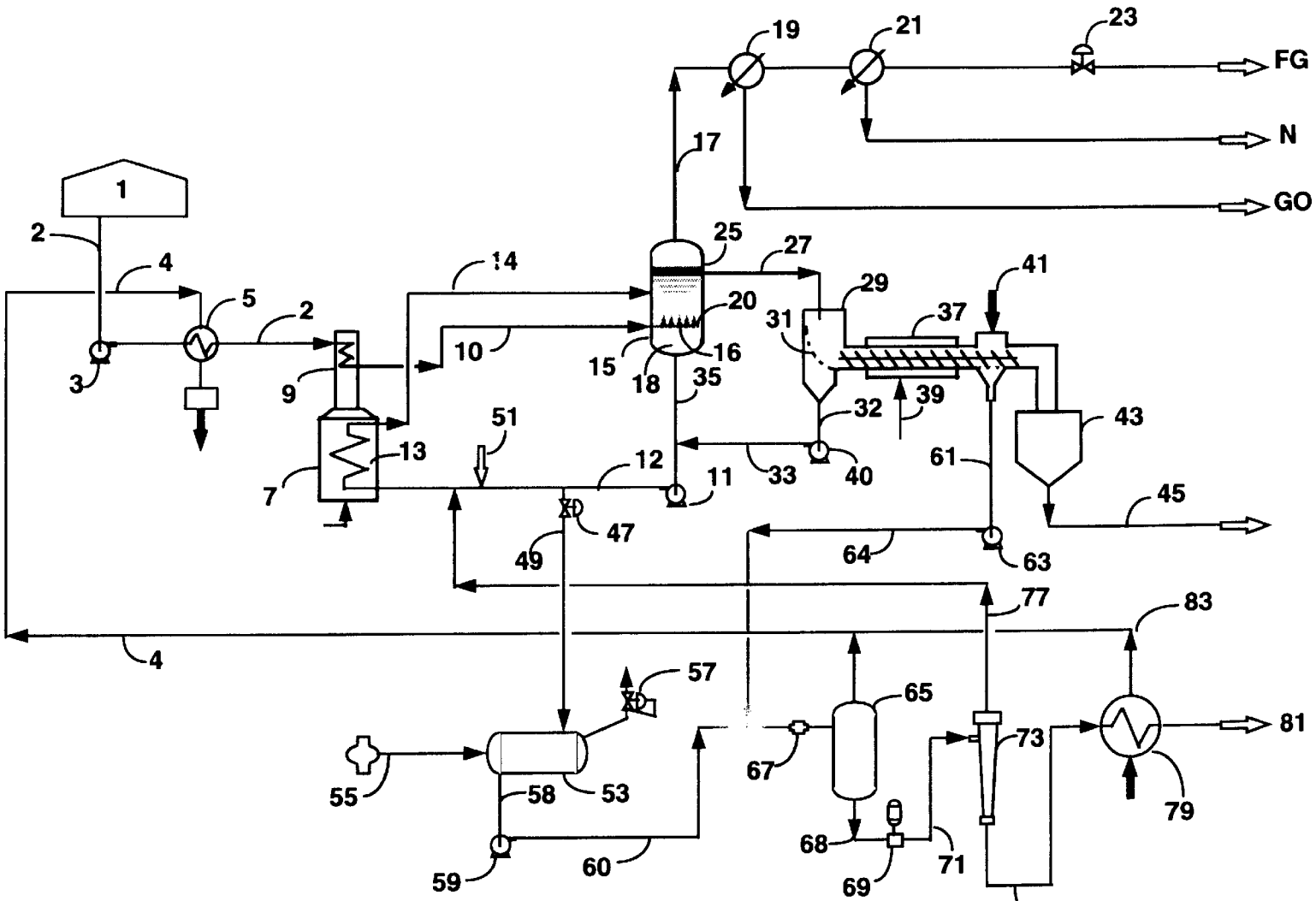
FIG. 2 shows, in schematic form, a preferred embodiment of the process suitable for continuous use in the practice of this invention.

A preferred embodiment of this invention is shown in FIG. 2, representing a schematic of a practical installation capable of processing about 5,000 barrels per day of a heavy petroleum residuum. It should be understood that this is provided herein solely for purposes of illustrating an embodiment of the present invention and should not be interpreted as limiting in any way the scope of this invention. Many other process configurations and equipment are available to the skilled process engineer to accomplish the objectives of the present invention.

Referring now to FIG. 2, a heavy petroleum residuum stream 2 from a storage vessel 1 is pumped by a conventional pump 3, at a rate of about 8700 gallons per hour into a contacting drum 15 through line 10. The petroleum residuum is preferably preheated before entering the contacting drum to prevent quenching of the reaction temperature. The petroleum residuum stream is preheated to a temperature of from about 40° C. to about 300° C., preferably from about 100° C. to about 200° C., by passing it through a steam preheater 5, and the convection section 9 of a gas-fired heating furnace 7. Of course, other ways of preheating the petroleum feedstock can be used which are well within the knowledge of a skilled process engineer. The preheated petroleum residuum coming out from furnace 7 enters a contacting drum 15 through line 10. A stream of molten alkali metal hydroxide preferably anhydrous caustic soda (sodium hydroxide) is added to the system from line 51 into line 12 and is circulated by a pump 11 through the radiant section 13 of furnace 7 to deliver the molten caustic soda at a temperature of at least about 450° C., preferably of from about 590° C. to about 650° C., into the upper portion of the contacting drum 15. The alkali metal hydroxide may be melted by any of many well known heating devices for fusing solids and which are well within the knowledge of a skilled process engineer.

Drum 15 is designed to provide a contacting time between the hydrocarbon feedstock and the caustic of from about 1 minute to about 30 minutes, preferably of from about 5 minutes to about 20 minutes, and most preferably from about 8 minutes to about 12 minutes, with a rate of molten caustic flow of about 2500 gallons per minute. The weight ratio of caustic to the hydrocarbon should be maintained greater than about 5, preferably of from about 10 to about 30 and most preferably of from about 20 to about 25. Drum 15 should be made out of material suitable to withstand the high temperature and corrosive environment of the hydrocarbon-caustic mixture. Preferably, the drum should be made out of a temperature resistant nickel alloy such as INCONEL™ 600 or INCONEL™ 625. INCONEL™ is a trademark for a series of corrosion resistant alloys of nickel and chromium.

The petroleum residuum stream 10 is injected into the lower portion of the contacting drum at a rate of from about 70 to 280 gallons per minute, preferably from about 120 to 170 gallons per minute, normally at about 145 gallons per minute, through a perforated distributor plate or like device 16. The distributor 16 is preferably horizontally oriented, and securely positioned within the bottom end of the drum. The perforated distributor plate 16 serves the purpose of subdividing the incoming fluid into small diameter streams, preferably droplets, thus improving the contact between the caustic and the petroleum residue. The perforations of distributor plate 16 should be not smaller than about 0.05 cm in diameter in order to avoid clogging, nor larger than about 0.5 cm in order to avoid formation of excessively large drops. Preferably, perforations should be of from about 0.1 cm to about 0.3 cm in diameter, set from about 1 to about 2 cm apart, on square or triangular pitch. The entire hole area should preferably range from about 10 to about 30 percent of the plate's cross section. The velocity through the holes should be such that drops do not form slowly at the holes, but rather that the petroleum feed streams through the openings to be broken up into droplets at a slight distance from the plate. This generally requires average linear velocities through the holes of from about 10 cm/s to about 40 cm/s, preferably from about 15 cm/s to about 30 cm/s. The petroleum residuum floats upwardly in counter-current flow through the molten alkali metal hydroxide which accumulates slowly at the bottom section 18 of the contacting drum 15, and subsequently is removed through line 35. The caustic flows over the perforated plate 16 and then through opening 20 formed between the perforated plate 16 and the contacting drum vertical wall and passes into the bottom section 18 of the drum. Care should be taken to provide for an opening cross-section area sufficient to permit most of the caustic feed to flow through opening 20 thus maintaining a constant level of caustic within the drum 15. Normally, at least 90 percent of the caustic feed will pass through opening 20 to the bottom section 18 of the contacting drum. About 10 percent of the caustic feed is entrained with the coke product that is withdrawn through line 27. A baffle (not shown) may be installed inside the contacting drum to improve mixing and prevent caustic bypass through opening 20 without coming into contact with the petroleum feed. The contacting drum 15 is preferably maintained at a sufficiently high pressure so that the cracked products, naphtha, gas oil, etc., can be conveniently condensed, leaving only some $C_1$ and $C_2$ hydrocarbons, hydrogen and water in gaseous form. The contacting drum 15 is thus kept under a slight super-atmospheric pressure, preferably of from about 70 to about 250 psig. Normally the pressure in the contacting drum may be kept at about 200 psig.

Inside the drum 15, the heated petroleum residuum decomposes to high purity coke and volatile products. The volatile products exit drum 15 through line 17 and pass through a series of condensers 19 and 21 to capture liquid products such as gas oil and naphtha, leaving uncondensed fuel gas. The fuel gas is released via pressure control valve 23.

The coke formed is of sufficiently low bulk density, typically of from about 0.8 to about 0.85 gr/cc so as to float on top of the molten alkali metal hydroxide. The coke is recovered by decanting the floating coke in a low-velocity flow zone of the melt through a restricted outlet 25 and line 27 into vessel 29 which is at a lower pressure. Vessel 29 has a screen 31 to separate coke from the molten alkali metal hydroxide and to allow any entrained molten caustic to drain through screen 31 into the bottom of vessel 29. Molten caustic exits vessel 29 through line 32 to pump 40 where it is moved through line 33 into the suction of the caustic recycle pump 11. The drained coke from chamber 29 is picked up by jacketed conveyor 37 where it is cooled by air injected through line 39 and subsequently water-washed by injecting steam condensate and make-up water through line 41, to remove any remaining caustic and to complete cooling of the coke to preferably below about 100° C. Of course other means for separating the coke from the entrained caustic soda can be used which are well within the knowledge of a skilled process engineer. The clean coke can then be transferred into hopper 43 for delivery into a transportation and/or storage facility through line 45. The coke is substantially free of sulfur and heavy metals. It can be used for anode grade coke applications or for clean fuels.

The recirculating caustic in line 35 together with the caustic recovered from line 33 is fed through recirculating pump 11 to the radiant section 13 of heater 7 where it is heated to a sufficiently high temperature so as to maintain the temperature inside drum 15 within the desired range. The heated caustic is then returned into drum 15 through line 14. A portion of the recycle caustic melt is bled off through valve 47 and is replenished with fresh pure caustic at 51 to allow the purity of the caustic melt to be kept at a suitable level, greater than about 95 percent by weight and preferably above about 98 percent by weight and most preferably above 99 percent by weight. The bleed stream 49 contains by-product sodium sulfide, alkali-heavy metal compounds such as sodium ferrite, sodium vanadate, sodium nickelate, and sodium silicate formed by the reaction of sulfur compounds, heavy metal oxides and silicon compounds found in the petroleum residuum feedstock with the caustic. The sulfide-containing bleed, containing typically from about 5 to about 8 percent by weight sodium sulfide, is released into aeration tank 53 which operates at a lower pressure ranging from about 50 psig to about 100 psig, and preferably of from about 60 psig to about 80 psig.

This aeration tank 53 is fed with air from air blower or compressor 55, serving to oxidize the contained sodium sulfide contained in the caustic bleed stream 49, to sodium sulfate which remains suspended in the molten caustic. Air exiting the aeration tank 53 is released to atmosphere through vent 57. Caustic exiting the aeration tank 53 through line 58 is pumped to about 200 psig using pump 59 and fed into flash drum 65 through flash control valve 67 and line 60. Flash drum 65 operates at a pressure of about 150 psig. A relatively small stream of water, which is recovered through line 61 from the washing section of the jacketed conveyor 37, is supplied by pump 63 through line 64 and release valve 67 into flash drum 65. A major part of the added water is thereby vaporized into about 150 psig steam, which is directed through line 4 to the preheat exchanger 5 for preheating the petroleum residue.

The molten caustic soda exits the bottom of flash drum 65 through line 68 and is moved by metering pump 69 through line 71 into a hydrocyclone bank 73. Hydrocyclone 73 accomplishes an enhanced-gravity separation of the sodium sulfate and heavy metal compounds as the heavy reject stream 75 thereby leaving a clean, caustic soda stream 77 which is returned to the main recirculating caustic melt loop. The pressure of stream 77 is kept sufficiently above the discharge pressure of pump 11 so that a controlled, steady flow can be maintained. The reject sodium sulfate stream 75 from hydrocyclone 73 is cooled in cooler 79 and may be purified if desired to produce a salable product 81, by removing the heavy metal compounds contained therein. A small stream 83 of additional 150 psig steam is generated from cooler 79.

The coke produced according to the process of this invention is of high purity and is suitable as anode grade type coke or low sulfur fuel. The heating value of the coke is about 14,500 btu/lb. The recovered coke is substantially free of sulfur, typically containing less than about 0.3 wt %, preferably less than about 0.15 wt % and most preferably, less than about 0.1 wt %. The coke is also low in heavy metals, moisture and volatile matter, and has a bulk density ranging from about 0.70 to about 0.90 gr/cc, preferably from about 0.85 to about 0.90 gr/cc. The ash content of the coke made according to this invention is less than about 0.1 percent by weight and most preferably less than about 0.08 percent by weight. The term "ash" as used herein, refers to the residue remaining after complete combustion of the coke. The coke also has less than about 0.1 percent by weight silicon, preferably less than about 0.06 percent by weight, and most preferably less than about 0.04 percent by weight. The coke's content of volatile matter is less than about 1.0 percent by weight, preferably less than about 0.7 percent by weight, and most preferably less than about 0.5 percent by weight. Finally, moisture content is less than about 0.2 percent by weight, preferably less than about 0.15 percent by weight, and most preferably less than about 0.10 percent by weight.

A typical composition of the coke initially discharged from the invention process is as follows:

| | |
|---|---|
| Moisture | 0.10 wt % |
| Volatile Matter | 0.40 wt % |
| Sulfur | 0.10 wt % |
| Silicon | 0.02 wt % |
| Iron | 0.02 wt % |
| Nickel | 0.01 wt % |
| Ash | 0.06 wt % |
| Vanadium | 0.01 wt % |

It should be noted that even a higher purity coke than the one listed above can be produced by optimizing the process parameters and by making minor process modifications which are well within the knowledge of a process engineer such as adding, for instance, a kiln to the tail end of the process.

A heavy petroleum residuum that can be used as feedstock in the coking process of the present invention is the bottoms fraction from a vacuum distillation column having an initial boiling temperature of about 430° C. or higher. Typically, vacuum tower bottoms include hydrocarbon material that is boiling above a selected temperature, which in most instances is between about 480° and 565° C. The exact cutoff point for the vacuum residuum is influenced by the type of refinery and the needs of the various units within the refinery. Generally, everything that can be distilled from the vacuum column is removed, such that the residuum includes only material which is not practicably distilled. However, as the vacuum residuum can now be converted to a valuable product, the cutoff point may be lowered without adversely affecting the economics of the refining operation.

The process of this invention is also applicable to other heavy petroleum residua such as certain heavy crude oils, tar sand bitumens, etc., which contain very little low boiling material, and a lot of sulfur and heavy metals. Also, the bottoms fraction from fluid catalytic cracking of petroleum can be used. All of these heavy petroleum residua can be used as feedstock in the instant coking process to produce high purity coke and valuable lighter hydrocarbons, without any pretreatment.

Generally, the heavy petroleum residuum feed to the process of the present invention contains from about 50 to about 500 parts per million heavy metals. These heavy metals will be largely converted into alkali metal heavy metal salts such as sodium ferrite, sodium vanadite, sodium nickelite, etcetera, that are soluble in the caustic and pass into the caustic soda melt. Also silicon compounds contained therein will be converted to alkali metal silicate such as sodium silicate. The heavy petroleum residuum feed typically contains from about 2 percent by weight to about 5 percent by weight sulfur, in the form of mercaptans, hydrogen sulfide, and cyclical compounds. These sulfur compounds are converted to sodium sulfide which is soluble in the caustic and also passe into the caustic soda melt.

The alkali metal hydroxide is preferably caustic soda (sodium hydroxide) or caustic potash (potassium hydroxide) and most preferably caustic soda. Although caustic potash has a higher reactivity and a lower melting point, it is much more expensive than caustic soda. Other alkali metal hydroxides could be used, but they are even more expensive. Other materials, besides anhydrous alkali metal hydroxides, which may be used are molten salts such as sodium chloride and molten metals such as lead or low melting alloys and mercury. However, molten salts create severe corrosion problems and are therefore not preferred. Likewise molten metals pose serious problems such as low reactivity, very high density, high cost and safety hazards.

Both concurrent and countercurrent flow may be used for contacting the molten alkali metal hydroxide with the hydrocarbon feedstock but preferably counter-current flow should be employed as shown in the preferred embodiment shown in FIG. 2. Counter-current flow has the advantage of achieving more uniform conditions through the contacting drum and enhances the extraction of the sulfur and metal compounds from the petroleum phase into the alkali metal hydroxide phase. Moreover, it does not require a separate vessel for separating the coke from the molten alkali metal hydroxide. Generally, in a concurrent flow arrangement, a high velocity impact device such as cyclone separator could be used to separate the coke from gases and liquids, thus facilitating separating out a cleaner high density coke and avoiding foaming. In an embodiment of the invention, a transfer-line contactor is provided, mixing hot caustic (or other heating medium) with the petroleum residuum and passing it through a tube at high velocity into a cyclone type separator, knocking out first the higher density solid material, followed by the heat transfer medium and the hydrocarbon products.

Instead of decanting the layer of coke as described above, other separation techniques could be used such as, for example, filtration with a raking or a sweeping system. If the coke is collected in a generally porous form containing volatile hydrocarbon or caustic melt, it could be picked up with a heavy duty extruder, driving the mixture into a high pressure zone containing a vent to release gas or liquid followed by continuing extrusion of the coke through a die head into the form of desirable pellets or spheres. Coke could also be delivered in the form of blocks or sheets. In another variation of the process, the coke mass could be extruded as pellets into water, thus cooling and washing the product.

Also, with regard to the melting of the anhydrous alkali metal hydroxide which normally comes in flake form, instead of circulating the alkali metal hydroxide at a high rate through furnace tubes, a large tank of alkali metal hydroxide could be heated by submerging tubes in the melt, and circulating hot flue gas or hot metal through the tubes. Other equipment and methods of melting the flakes are well known to those skilled in the art.

Material for the furnace and process contacting the alkali metal hydroxide melt should be selected to withstand the corrosion possibility at process conditions. The nickel alloys, INCONEL™ 600 or 625, are especially preferred.

EXAMPLES

To further illustrate the present invention, the following embodiments are given. It is to be understood, however, that the embodiments are given for the purpose of illustration only and that the invention is not to be regarded as limited to any of the specific materials or conditions used in the specific embodiments.

For purposes of convenience, unless otherwise clearly set forth, percentages are given in this specification by weight, but may be volume ratios or percentages where other methods of reporting are preferred.

Example 1

In a 2 liter autoclave, 2,000 grams of anhydrous sodium hydroxide are charged, and 150 grams of a 1.02 specific gravity (7° API) petroleum residuum from vacuum distillation are added. The autoclave is purged with nitrogen, then sealed and a 10 rpm agitator is turned on. The autoclave is electrically heated to 593° C. and allowed to remain under agitation for ten minutes. The pressure, which had risen to about 400 psig, is then released through a valve at the top of the autoclave, down to about 0.5 psig, the gasses released being collected through an ice-cooled condenser. The autoclave is then slowly opened after cooling to about 315° C., and the contents poured out through a 150 mesh stainless steel screen, which collected about 95% of the suspended coke. The coke on the screen is water washed to remove adhering sodium hydroxide. The following yields are obtained:

| PRODUCT YIELDED | WEIGHT IN GRAMS | SULFUR CONTENT |
|---|---|---|
| Coke | 95 | 0.20% |
| Light Fuel Oil | 24 | 0.20% |
| Light Naphtha | 19 | 0.05% |
| Gas | 8 | 0.00% |
| Total | 146 | |

The sulfur content of the petroleum residuum originally charged is 3 percent by weight, equivalent to 4.5 grams of sulfur in the feed. The sulfur content of the products is about 0.25 grams, leaving 4.25 grams reacted with the caustic soda in the form of sodium sulfide.

Example 2

One hundred grams of molten sodium hydroxide containing 0.5 percent by weight sodium sulfide are placed in a nickel beaker. A metal disc with 1 millimeter perforations is set in the bottom of the beaker and connected with a nickel tube supplying air beneath the disc. The molten sodium hydroxide is blown with hot air having a temperature of from about 260° C. to about 316° C., for about 15 minutes, while the beaker is gently agitated.

Then, a sample of the sodium hydroxide is taken and analyzed. The sodium sulfide content is dropped to 0.01 percent, having been converted largely to sodium sulfate.

From the foregoing description and specific examples and embodiments of the present invention, those of ordinary skill in the pertinent art would recognize many other variations of the practice of the invention set forth in the disclosure above and covered by the appended claims without departing from the intended scope of the invention as defined by the appended claims.

What is claimed is:

1. A coking process for making a coke product substantially free of heavy metals and sulfur from a heavy petroleum residuum, which method comprises the steps of:

contacting a molten anhydrous alkali metal hydroxide with the petroleum residue under process conditions selected to convert said petroleum residuum to a coke product and volatiles and to substantially remove any heavy metals and sulfur found in the petroleum residuum; and recovering the coke product wherein said coke product is substantially free of heavy metals and sulfur.

2. A coking process for making a coke product substantially free of sulfur and heavy metals from a heavy petroleum residuum, which comprises the steps of:

heating a molten anhydrous alkali metal hydroxide;

contacting said heated molten anhydrous alkali metal hydroxide with the petroleum residuum to heat said petroleum residuum to an effective temperature and for a time sufficient to convert substantially all petroleum residuum to coke and volatile compounds and to react substantially all sulfur and heavy metals contained in the petroleum residuum to reaction products soluble in the alkali metal hydroxide; and recovering the coke, said coke being substantially free of sulfur and heavy metals.

3. The coking process of claim 2 wherein the alkali metal hydroxide is selected from the group consisting of sodium hydroxide and potassium hydroxide.

4. The coking process of claim 3 wherein the alkali metal hydroxide is sodium hydroxide.

5. The coking process of claim 4 wherein the molten alkali metal hydroxide is heated to a temperature of from about 590° C. to about 650° C. and said contacting step involves heating the petroleum residuum from a temperature of less than about 200° C. to an effective coking and desulfurization temperature, and said contacting time is from about 1 to about 30 minutes.

6. The coking process of claim 5 wherein the reaction products are sodium sulfide and corresponding alkali metal compounds of the heavy metal.

7. The coking process of claim 5 further comprising the step of separating the volatile products to recover a light naphtha, a gas oil, and a high heating value gas.

8. The coking process of claim 5 wherein the recovering of the coke step involves separating continuously the coke by floatation.

9. The coking process of claim 2 wherein the coke product contains less than about 0.15 percent by weight sulfur.

10. The coking process of claim 9 wherein the coke product contains less than about 0.10 percent by weight sulfur.

11. The coking process of claim 10 wherein the coke product contains less than 0.1 percent by weight silicon.

12. The coking process of claim 11 wherein the coke product contains less than 0.1 percent by weight iron.

13. The coking process of claim 12 wherein the coke product contains less than 0.1 percent by weight nickel.

14. The coking process of claim 13 wherein the coke product contains less than 0.1 percent by weight ash.

15. The coking process of claim 14 wherein the coke product contains less than 0.05 percent by weight vanadium.

16. The coking process of claim 15 wherein the coke product has a bulk density of from about 0.80 to about 0.85 gr/cc.

17. The coking process of claim 16 wherein the contacting step is performed within a baffled contacting drum.

18. The coking process of claim 17 wherein the contacting step involves:

injecting the heavy petroleum residuum through a perforated inlet device positioned within a lower portion of the drum;

flowing said alkali metal hydroxide in countercurrent flow with the heavy petroleum residuum whereby substantially all sulfur and heavy metals contained in said petroleum residuum react with the alkali metal hydroxide to form reaction products soluble in the alkali metal hydroxide; and withdrawing continuously the alkali metal hydroxide containing said reaction products.

19. The coking process of claim 18 wherein the diameter of the contacting drum is sufficiently large to preclude entrainment of solids and liquids by the liberated volatile products.

20. The coking process of claim 19 wherein the contacting drum is maintained at a pressure of at least 100 psig.

21. The coking process of claim 20 wherein the coke is of sufficiently low density so as to float on top of the molten alkali metal hydroxide, and the recovery step comprises of overflowing the floating coke in a low-velocity flow zone of the melt through a restricted outlet into a lower pressure vessel.

22. The coking process of claim 21 further comprising the steps of spraying the recovered coke with water to cool it and to wash off any entrained caustic soda and recovering the clean coke.

23. The coking process of claim 22 wherein the spraying step with water occurs in a closed chamber so that the steam generated by the contacting of water with the hot coke is collected at a pressure of above about 20 psig.

24. The coking process of claim 1 wherein the coke product contains less than about 0.15 percent by weight sulfur and less than about 0.1 percent by weight heavy metals.

25. The coking process of claim 24 wherein the coke product contains less than about 0.08 percent by weight ash.

26. A coking process for making a coke product substantially free of heavy metals and sulfur from a heavy petroleum residuum, which method comprises the steps of:

feeding the heavy petroleum residuum into a contacting drum;

feeding a molten anhydrous alkali metal hydroxide stream into the drum at a rate sufficient to maintain a weight ratio of alkali metal hydroxide to petroleum residuum of at least about five to one, said alkali metal hydroxide stream being greater than 95 percent pure;

contacting said heavy petroleum residuum by flowing it upwardly and in countercurrent flow to the alkali metal hydroxide melt, through a perforated distributor at a linear velocity of from about 10 cm/s to about 40 cm/s to form droplets of the heavy petroleum residuum as it flows through the alkali metal hydroxide melt;

heating the incoming stream of alkali metal hydroxide to a sufficient temperature to maintain the hydrocarbon inside the drum to a temperature of at least 450° C., under a superatmospheric pressure;

maintaining the heavy petroleum residuum in contact with the molten alkali metal hydroxide for a period of time from about 1 minute to about 30 minutes to form coke and volatile products and extract sulfur and heavy metal compounds from the heavy petroleum residuum into the alkali metal hydroxide phase;

decanting the coke together with entrained alkali metal hydroxide melt through a side stream outlet;

separating the coke from the entrained alkali metal hydroxide using filter means; and recovering the coke.

* * * * *